US010005090B1

(12) United States Patent
Wang et al.

(10) Patent No.: US 10,005,090 B1
(45) Date of Patent: Jun. 26, 2018

(54) SHOWER HEAD STRUCTURE

(71) Applicant: Xiamen Lota International Co., Ltd., Xiamen (CN)

(72) Inventors: Xuedong Wang, Xiamen (CN); Jiangcheng Zhang, Xiamen (CN); Jianyuan Cai, Xiamen (CN)

(73) Assignee: XIAMEN LOTA INTERNATIONAL CO., LTD., Xiamen (CN)

( * ) Notice: Subject to any disclaimer, the term of this patent is extended or adjusted under 35 U.S.C. 154(b) by 0 days. days.

(21) Appl. No.: 15/691,781

(22) Filed: Aug. 31, 2017

(30) Foreign Application Priority Data

May 27, 2017 (CN) ..... 2017 2 0614134 U

(51) Int. Cl.
*B05B 1/16* (2006.01)
*B05B 1/18* (2006.01)
*E03C 1/04* (2006.01)

(52) U.S. Cl.
CPC ..... *B05B 1/1618* (2013.01); *B05B 1/16* (2013.01); *B05B 1/18* (2013.01); *B05B 1/185* (2013.01); *E03C 1/0408* (2013.01)

(58) Field of Classification Search
CPC ..... B05B 1/18; B05B 1/185; B05B 1/1618; B05B 1/1672; E03C 1/0408
USPC ..... 239/443, 393, 436, 451, 456, 460, 537, 239/541, 548, 552, 553.5, 587.3, 587.4, 239/564, 565, 562, 581.1, 581.2, 582.1, 239/583, 538, 539, 563
See application file for complete search history.

(56) References Cited

U.S. PATENT DOCUMENTS 3,403,860 A * 10/1968 Shames ..... B05B 1/3086 239/460
3,967,783 A * 7/1976 Halsted ..... B05B 1/1663 239/381
4,089,471 A * 5/1978 Koenig ..... B05B 1/083 239/381
4,254,914 A * 3/1981 Shames ..... B05B 1/1636 239/222.17
4,669,666 A * 6/1987 Finkbeiner ..... B05B 1/3086 239/438
5,860,599 A * 1/1999 Lin ..... B05B 1/1681 239/380
2012/0181356 A1* 7/2012 Miller ..... B05B 1/185 239/548

* cited by examiner

*Primary Examiner* — Christopher Kim
*Assistant Examiner* — Tuongminh Pham
(74) *Attorney, Agent, or Firm* — Leong C. Lei

(57) ABSTRACT

A shower head structure includes a housing and a panel. A middle of the panel is provided with a guide valve. A first functional water chamber is formed between the guide valve and the housing. An upper part of the guide valve is formed with a water inlet chamber. A lower part of the guide valve is formed with at least one second functional water chamber. A middle portion of the guide valve is formed with a water inlet, a first water discharge passage, and a second water discharge passage. A rotary shaft is provided in the accommodation chamber. Another end of the rotary shaft extends outward to form an eccentric connecting rod. The eccentric connecting rod is connected with a piston which controls the water intensity of the first functional water chamber.

6 Claims, 5 Drawing Sheets

SHOWER HEAD STRUCTURE

BACKGROUND OF THE INVENTION

Field of the Invention

The present invention relates to a bathroom accessory, and more particularly to a shower head structure.

Description of the Prior Art

A conventional multifunctional shower head provides a variety of functional modes for the user to choose, such as, spraying shower water, bubble water, massage water, and so on. The shower head is provided with multiple diversion passages corresponding to multiple second functional water chambers and cooperating with a panel to achieve multiple functional modes. In general, the panel is rotated to switch the multiple functional modes. People need to operate the shower head with both hands for switching a desired functional mode. The operation is laborious and inconvenient. If the panel is non-circular, it is unable to rotate the panel for switching a desired functional mode. This multifunctional shower head only adjusts the way to spray water. As to a certain spray way, it is required to install a flow valve for the shower head to adjust the water intensity (that is, the flow rate). The existing shower heads do not have an adjustment structure able to adjust both the spray mode and the flow rate. This is inconvenient for use.

SUMMARY OF THE INVENTION

The primary object of the present invention is to provide a shower head structure which is able to switch a different spray mode and control the amount of the water outflow of at least one water chamber to improve the functions of the shower head.

In order to achieve the aforesaid object, the shower head structure of the present invention comprises a housing and a panel to mate with each other. A middle of the panel is provided with a guide valve. A first functional water chamber is formed between the guide valve and the housing. An upper part of the guide valve is formed with a water inlet chamber. A lower part of the guide valve is formed with at least one second functional water chamber. A middle portion of the guide valve is formed with a transverse accommodation chamber. The accommodation chamber is provided with a water inlet communicating with the water inlet chamber, a first water discharge passage communicating with the first functional water chamber, and a second water discharge passage communicating with the second functional water chamber. A rotary shaft is provided in the accommodation chamber. The rotary shaft is rotatable for controlling the first water discharge passage to communicate with the second water discharge passage. The housing is provided with a handle connected to one end of the rotary shaft. An outlet of the first functional water chamber is provided with a control valve. An outer wall of the guide valve is provided with a piston fixedly connected to the control valve. Another end of the rotary shaft extends outward to form an eccentric connecting rod. The eccentric connecting rod is connected with the piston so that the rotary shaft is rotated to drive the piston to move up and down.

Preferably, the rotary shaft is a hollow structure. The rotary shaft has a passage therein. An outer wall of the rotary shaft is formed with an annular groove. A chamber is formed between the annular groove and an inner wall of the accommodation chamber. The first discharge passage communicates with the chamber. The annular groove is fitted with a stopper. The stopper is movable to block the first water discharge passage. The rotary shaft is formed with at least one aperture for the passage to communicate with the chamber. The rotary shaft further has a through hole communicating with the passage. The through hole is configured to communicate with the second water discharge passage.

Preferably, the first water discharge passage is perpendicular to the second water discharge passage, and the stopper is perpendicular to the through hole.

Preferably, an O-shaped ring is provided between the rotary shaft and the accommodation chamber.

Preferably, the second discharge passage is fitted with a sealing ring on an opening in contact with the rotary shaft.

Preferably, the first functional water chamber is a shower water chamber, and the second functional water chamber is a massage water chamber.

The rotation of the rotary shaft of the present invention controls the communication state of the first water outlet passage and the second water discharge passage for controlling the first functional water chamber and the second functional water chamber to discharge water or not, thereby switching the outflow mode. Through the eccentric connecting rod to move the piston up and down, the water intensity of the first functional water chamber can be changed, enhancing the functions of the shower head.

DETAILED DESCRIPTION OF THE PREFERRED EMBODIMENTS

Figure 1:
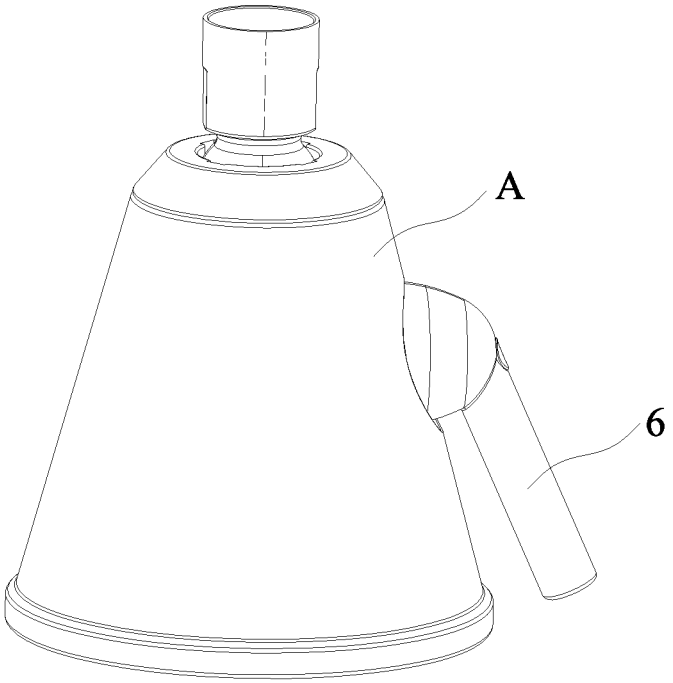
FIG. 1 is a perspective view of the present invention when in use (the handle is turned by 0°)

Embodiments of the present invention will now be described, by way of example only, with reference to the accompanying drawings.

As shown in FIG. 1 to FIG. 9, the present invention discloses a shower head structure. The shower head structure comprises a housing A and a panel B to mate with each other. The middle of the panel B is provided with a guide valve C. A first functional water chamber 1 is formed between the guide valve C and the housing A. An upper part of the guide valve C is formed with a water inlet chamber 2. A lower part of the guide valve C is formed with at least one second functional water chamber 3. A middle portion of the guide valve C is formed with a transverse accommodation chamber 4.

The accommodation chamber 4 is provided with a water inlet 41 communicating with the water inlet chamber 2, a first water discharge passage 42 communicating with the first functional water chamber 1, and a second water discharge passage 43 communicating with the second functional water chamber 3. A rotary shaft 5 is provided in the accommodation chamber 4. The housing A is provided with a handle 6 connected to one end of the rotary shaft 5. The rotary shaft 5 is controlled and rotated by turning the handle 6. The rotary shaft 5 is rotated for controlling the first water discharge passage 42 to communicate with the second water discharge passage 43.

An outlet of the first functional water chamber 1 is provided with a control valve 11. An outer wall of the guide valve C is provided with a piston 7 fixedly connected to the control valve 11. Another end of the rotary shaft 5 extends outward to form an eccentric connecting rod 8. The eccentric connecting rod 8 is connected with the piston 7 so that the rotary shaft 5 is rotated to drive the piston 7 to move up and down to compress the control valve 11 or to pull the control valve 11 for changing the water intensity of the first functional water chamber 1.

Specifically, the rotary shaft 5 is a hollow structure. The rotary shaft 5 has a passage 51 therein. An O-shaped ring a is provided between the rotary shaft 5 and the accommodation chamber 4 to ensure the airtightness. An outer wall of the rotary shaft 5 is formed with an annular groove 52. A chamber is formed between the annular groove 52 and an inner wall of the accommodation chamber 4. The first discharge passage 42 communicates with the chamber. The annular groove 53 is fitted with a stopper 53. The stopper 53 is movable to block the first water discharge passage 42. The rotary shaft 5 is formed with at least one aperture 521 for the passage 51 to communicate with the chamber. The rotary shaft 5 further has a through hole 54 communicating with the passage 51. The through hole 54 is configured to communicate with the second water discharge passage 43. The second discharge passage 43 is fitted with a sealing ring b on an opening in contact with the rotary shaft 5 to ensure the airtightness between the rotary shaft 5 and the second discharge passage 43.

In the normal state of the present invention, the first functional water chamber 1 is opened to discharge water and the second functional water chamber 3 is closed. When the rotary shaft 5 is rotated by the handle 6, the rotary shaft 5 drives the piston 7 to move up and down to change the water intensity of the first functional water chamber 1. The first water discharge passage 42 can be blocked by the stopper 53 when the rotary shaft 5 is turned to a predetermined angle. When the through hole 54 is aligned with the second water discharge passage 43, the second functional water chamber 3 is opened to discharge water for switching the spray mode.

Figure 2:
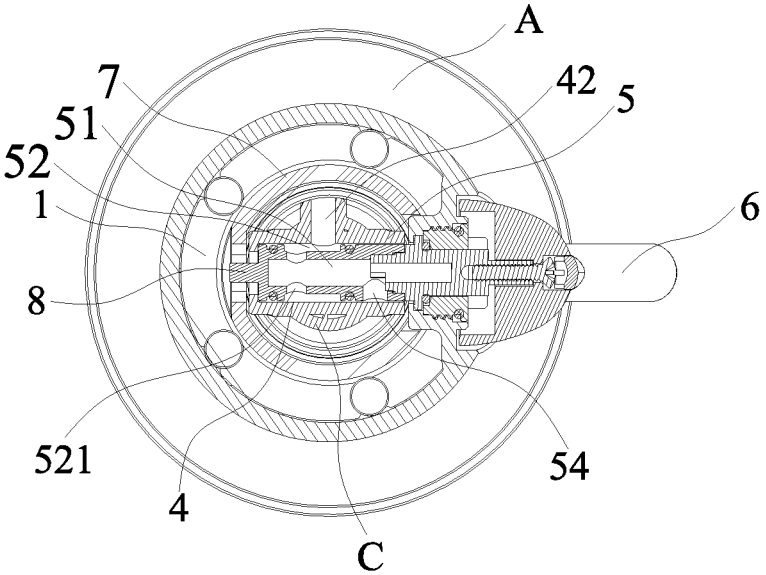
FIG. 2 is a lateral sectional view of FIG. 1.
Figure 3:
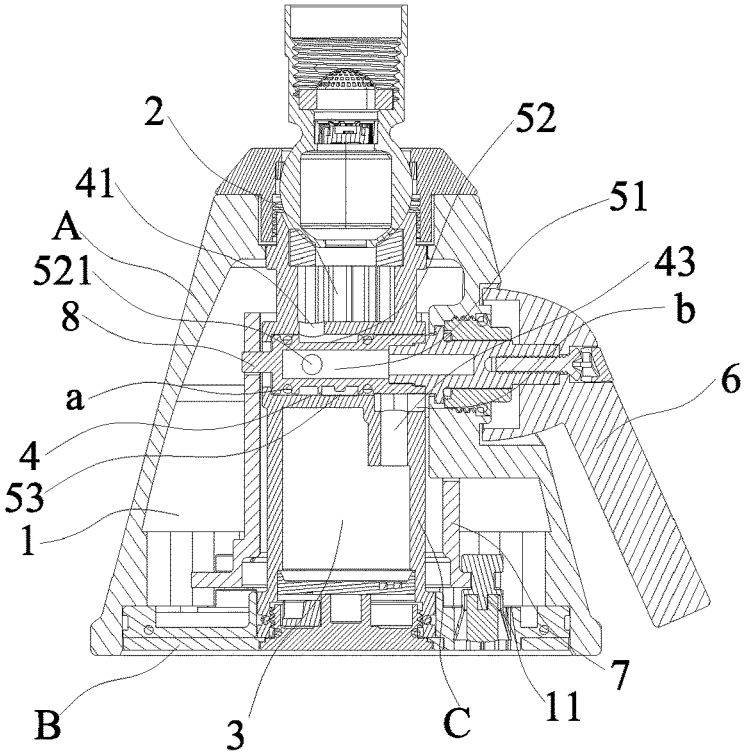
FIG. 3 is a longitudinal sectional view of FIG. 1.
Figure 4:
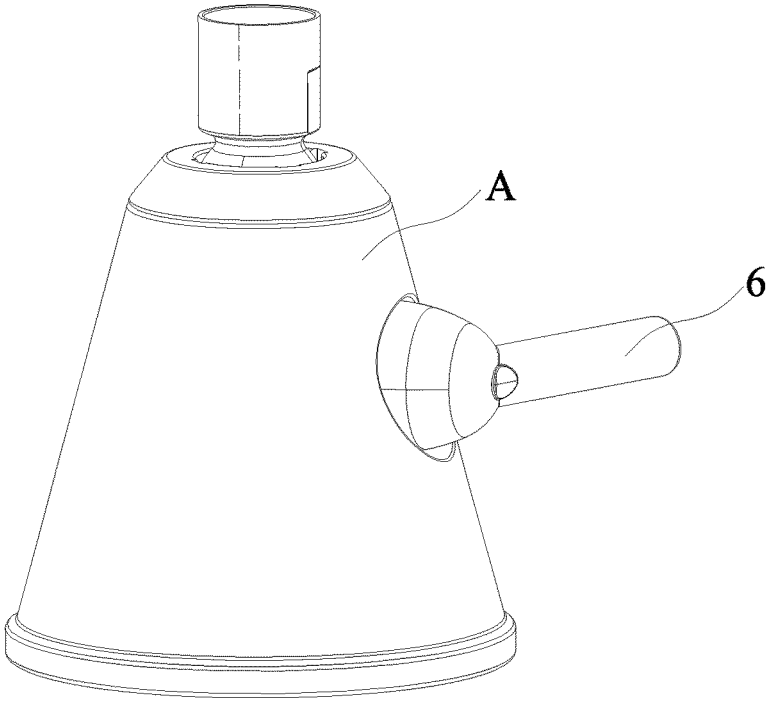
FIG. 4 is a perspective view of the present invention when in use (the handle is turned by 270°)
Figure 5:
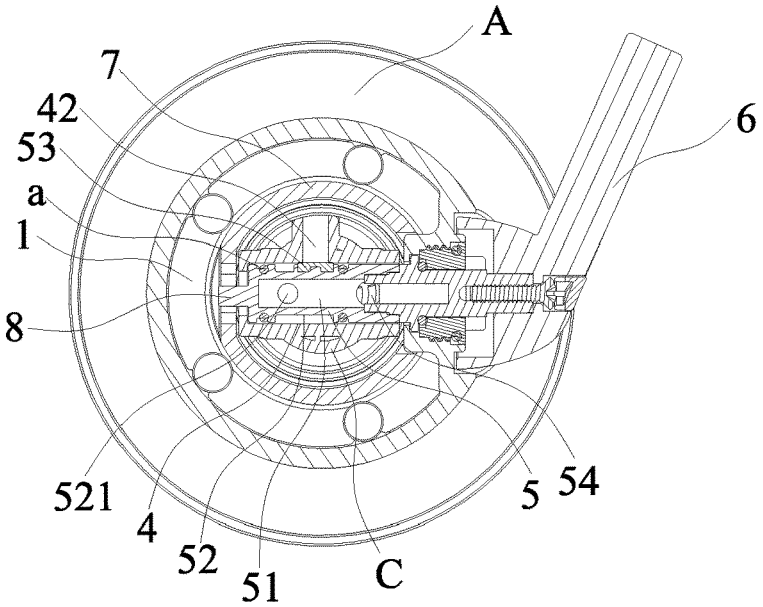
FIG. 5 is a lateral sectional view of FIG. 4.
Figure 6:
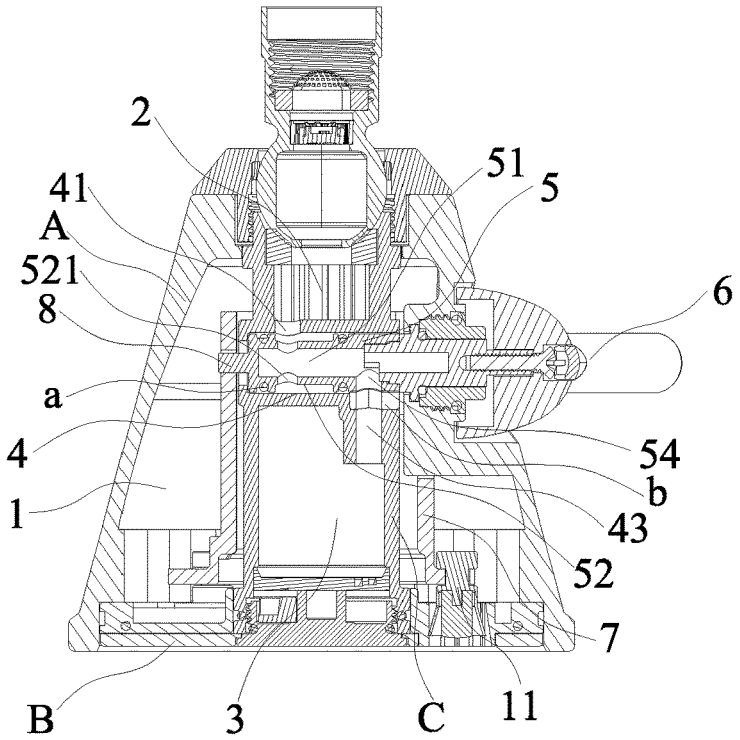
FIG. 6 is a longitudinal sectional view of FIG. 4.
Figure 7:
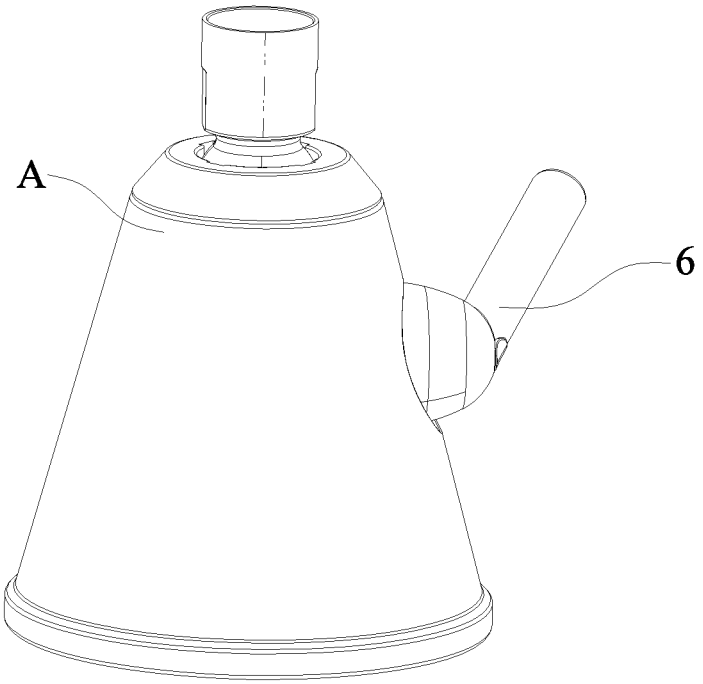
FIG. 7 is a perspective view of the present invention when in use (the handle is turned by 310°)
Figure 8:
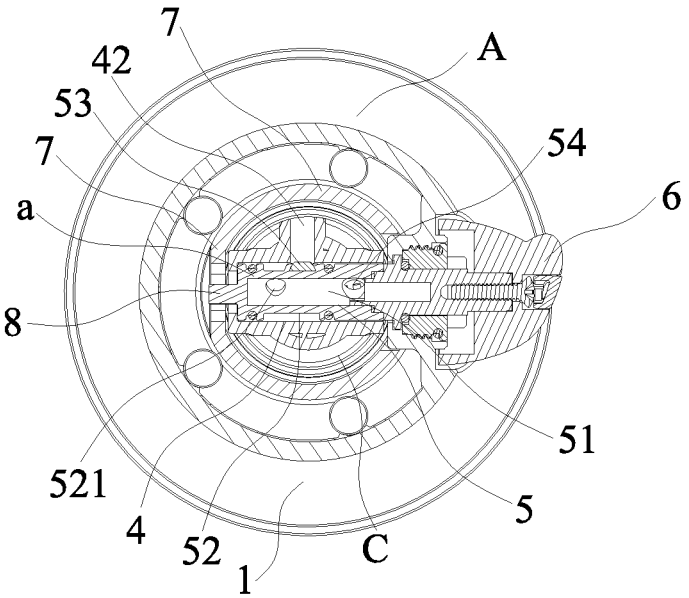
FIG. 8 is a lateral sectional view of FIG. 7.
Figure 9:
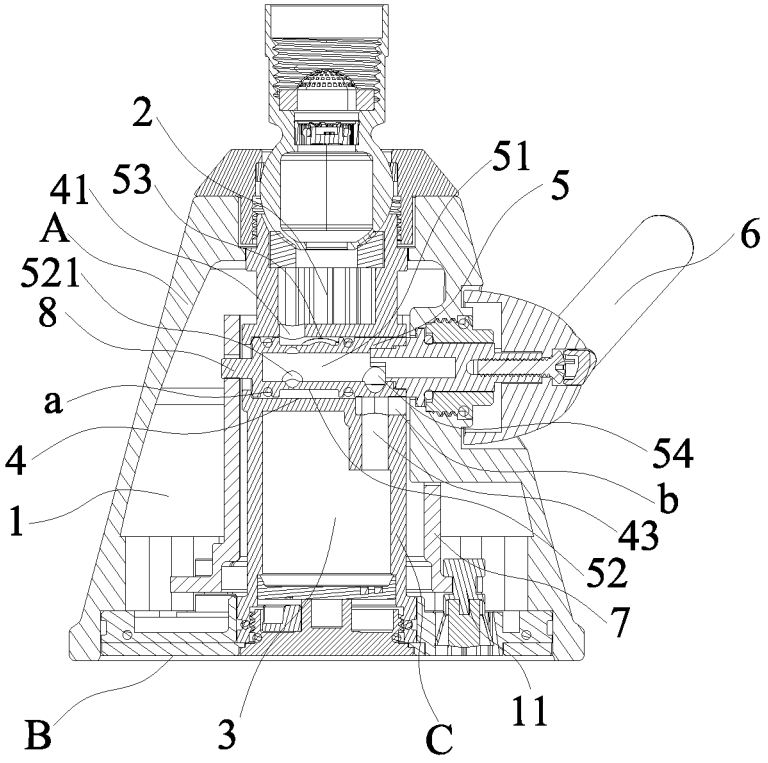
FIG. 9 is a longitudinal sectional view of FIG. 7.

Preferably, the first functional water chamber 1 is a shower water chamber. The second functional water chamber 3 is a massage water chamber. The first water discharge passage 42 is perpendicular to the second water discharge passage 43. The stopper 53 is perpendicular to the through hole 54. The first water discharge passage 42 and the second discharge passage 43 occupy an angle of 100° in the circular cross section of the accommodation chamber 4, respectively. Therefore, when the present invention is used, as shown in FIG. 1 to FIG. 3, when the water intensity of the shower water chamber is the maximum and the massage water chamber is closed, and the handle 6 is turned by 0°. When the handle 6 is turned by 40° to 220°, the stopper 53 does not block the first water discharge passage 42, and the through hole 54 is not aligned with the second water discharge passage 43, and the rotary shaft 5 is rotated to drive the piston 7 to move up and down for changing the water intensity of the shower water chamber. When the handle 6 is turned by 180°, the water intensity of the shower water chamber is the minimum. When the handle 6 is turned by 220°-270°, the stopper 53 partially blocks the first water discharge passage 42, and the through hole 54 is partially aligned with the second water discharge passage 43. Both the massage water chamber and the shower water chamber are opened to discharge water, namely, in a mixed outflow state. The rotary shaft 5 is rotated to drive the piston 7 to move up and down for changing the water intensity of the shower water chamber. As shown in FIG. 4 to FIG. 6, when the handle 6 is turned by 270°, the stopper 53 completely closes the first water discharge passage 42, and the through hole 54 is completely aligned with the second water discharge passage 43. Only the massage water chamber is opened to discharge water, and the shower water chamber is closed. When the handle 6 is turned by 270°-320°, as shown in FIG. 7 to FIG. 9, the stopper 53 partially blocks the first water discharge passage 42, and the through hole 54 is partially aligned with the second water discharge passage 43. Both the massage water chamber and the shower water chamber are opened to discharge water. The rotary shaft 5 is rotated to drive the piston 7 to move up and down for changing the water intensity of the shower water chamber. At this time, the shower head is in a mixed outflow state.

As described above, the rotation of the rotary shaft 5 of the present invention controls the communication state of the first water outlet passage 42 and the second water discharge passage 43 for controlling the first functional water chamber 1 and the second functional water chamber 3 to discharge water or not, thereby switching the outflow mode. Through the eccentric connecting rod 8 to move the piston 7 up and down, the water intensity of the first functional water chamber 1 can be changed, enhancing the functions of the shower head.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head structure, comprising a housing and a panel to mate with each other, characterized by: a middle of the panel being provided with a guide valve, a first functional water chamber being formed between the guide valve and the housing; an upper part of the guide valve being formed with a water inlet chamber, a lower part of the guide valve being formed with at least one second functional water chamber, a middle portion of the guide valve being formed with a transverse accommodation chamber;

the accommodation chamber being provided with a water inlet communicating with the water inlet chamber, a first water discharge passage communicating with the first functional water chamber, and a second water discharge passage communicating with the second functional water chamber;

a rotary shaft being provided in the accommodation chamber, the rotary shaft being rotatable for controlling the first water discharge passage to communicate with the second water discharge passage, the housing being provided with a handle connected to one end of the rotary shaft;

an outlet of the first functional water chamber being provided with a control valve, an outer wall of the guide valve being provided with a piston fixedly connected to the control valve, another end of the rotary shaft extending outward to form an eccentric connecting rod, the eccentric connecting rod being connected with the piston so that the rotary shaft is rotated to drive the piston to move up and down.

2. The shower head structure as claimed in claim 1, wherein the rotary shaft is a hollow structure, the rotary shaft has a passage therein, an outer wall of the rotary shaft is formed with an annular groove, a chamber is formed between the annular groove and an inner wall of the accommodation chamber, the first discharge passage communicates with the chamber, the annular groove is fitted with a stopper, the stopper is movable to block the first water discharge passage; the rotary shaft is formed with at least one aperture for the passage to communicate with the chamber, the rotary shaft further has a through hole communicating with the passage, and the through hole is configured to communicate with the second water discharge passage.

3. The shower head structure as claimed in claim 2, wherein the first water discharge passage is perpendicular to the second water discharge passage, and the stopper is perpendicular to the through hole.

4. The shower head structure as claimed in claim 1, wherein an O-shaped ring is provided between the rotary shaft and the accommodation chamber.

5. The shower head structure as claimed in claim 1, wherein the second discharge passage is fitted with a sealing ring on an opening in contact with the rotary shaft.

6. The shower head structure as claimed in claim 1, wherein the first functional water chamber is a shower water chamber, and the second functional water chamber is a massage water chamber.

* * * * *